US006892415B2

(12) United States Patent
Libman et al.

(10) Patent No.: US 6,892,415 B2
(45) Date of Patent: May 17, 2005

(54) MOP WITH ATTACHED SCRUBBER

(75) Inventors: Robert J. Libman, Champaign, IL (US); Enzo Berti, Dolo/Venice (IT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 10/402,597

(22) Filed: Mar. 28, 2003

(65) Prior Publication Data

US 2004/0187239 A1 Sep. 30, 2004

(51) Int. Cl.[7] ..... A47L 13/12
(52) U.S. Cl. ..... 15/116.2; 15/115; 15/118
(58) Field of Search ..... 15/114–116.2, 15/118, 119.2, 176.1, 176.4, 176.5, 176.6

(56) References Cited

U.S. PATENT DOCUMENTS

| | | | | | |
|---|---|---|---|---|---|
| 701,657 | A | * | 6/1902 | Wilson | 15/115 |
| 3,008,165 | A | * | 11/1961 | Scholl | 15/176.5 |
| 3,050,761 | A | * | 8/1962 | Morgan | 15/119.2 |
| 3,088,165 | A | * | 5/1963 | Bellis | 452/128 |
| D351,267 | S | | 10/1994 | Libman | D32/44 |
| D401,702 | S | | 11/1998 | Berti | D32/44 |
| 5,896,613 | A | * | 4/1999 | Courtney et al. | 15/119.2 |
| 6,336,240 | B1 | * | 1/2002 | Laux et al. | 15/104.94 |
| 2003/0135946 | A1 | * | 7/2003 | MacLean | 15/176.4 |

FOREIGN PATENT DOCUMENTS

| | | | |
|---|---|---|---|
| DE | 3834301 | * | 4/1990 |

* cited by examiner

*Primary Examiner*—Mark Spisich
(74) *Attorney, Agent, or Firm*—Banner & Witcoff, Ltd.

(57) ABSTRACT

A scrubber with a triangular cross section is attached to a sponge mop so that the scrubber face is angled at an angle of about 60° in one direction with respect to the handle, and the sponge mop element is angled at an angle of about 60° in the opposite direction with respect to the handle. The scrubber is attached with a pair of mounting stems. The mounting stems take the form of walls that are spaced at a distance apart. There is an outwardly-facing ridge on each wall that extends from the wall by no more than half the distance between the walls. Each set of walls extends through an aperture on a mounting head, and the scrubber is held in place by the engagement of the ridges with a mounting face on the mounting head. The mounting stems are spaced at least about two inches apart, and the opposed walls extend perpendicularly to the length of the body of the scrubber. The sponge mop element covers the ridges, helping to prevent inadvertent disengagement.

19 Claims, 3 Drawing Sheets

MOP WITH ATTACHED SCRUBBER

BACKGROUND OF THE INVENTION

The present invention relates generally to mops, and more particularly to mops with attached scrubbers.

BRIEF DESCRIPTION OF THE INVENTION

A convenient new structure has been developed for attaching a scrubber to a mop. Like some previously-known mops, a mop in accordance with the present invention has a handle and a mounting head that is connected to the handle. A sponge mop element is mounted on the mounting head. The mop also has a scrubber.

The scrubber is held to the mounting head by an engagement between a first wall and an aperture, and by an engagement with a second wall. A ridge on the first wall extends in one direction on a line between the two walls, while a second ridge on the second wall extends in the opposite direction.

Further advantages can be derived through the use of a separate mounting stem that is spaced at least about two inches away from the walls. The mounting stem can be used to engage a second aperture, providing more stability to the scrubber connection. Angling the mounting face on which the scrubber is mounted, and configuring the scrubber with a triangular configuration can also provide useful advantages.

BRIEF DESCRIPTION OF THE DRAWINGS

The invention may be better understood by referring to the accompanying drawings, in which.

DETAILED DESCRIPTION OF THE DRAWINGS

Figure 1:
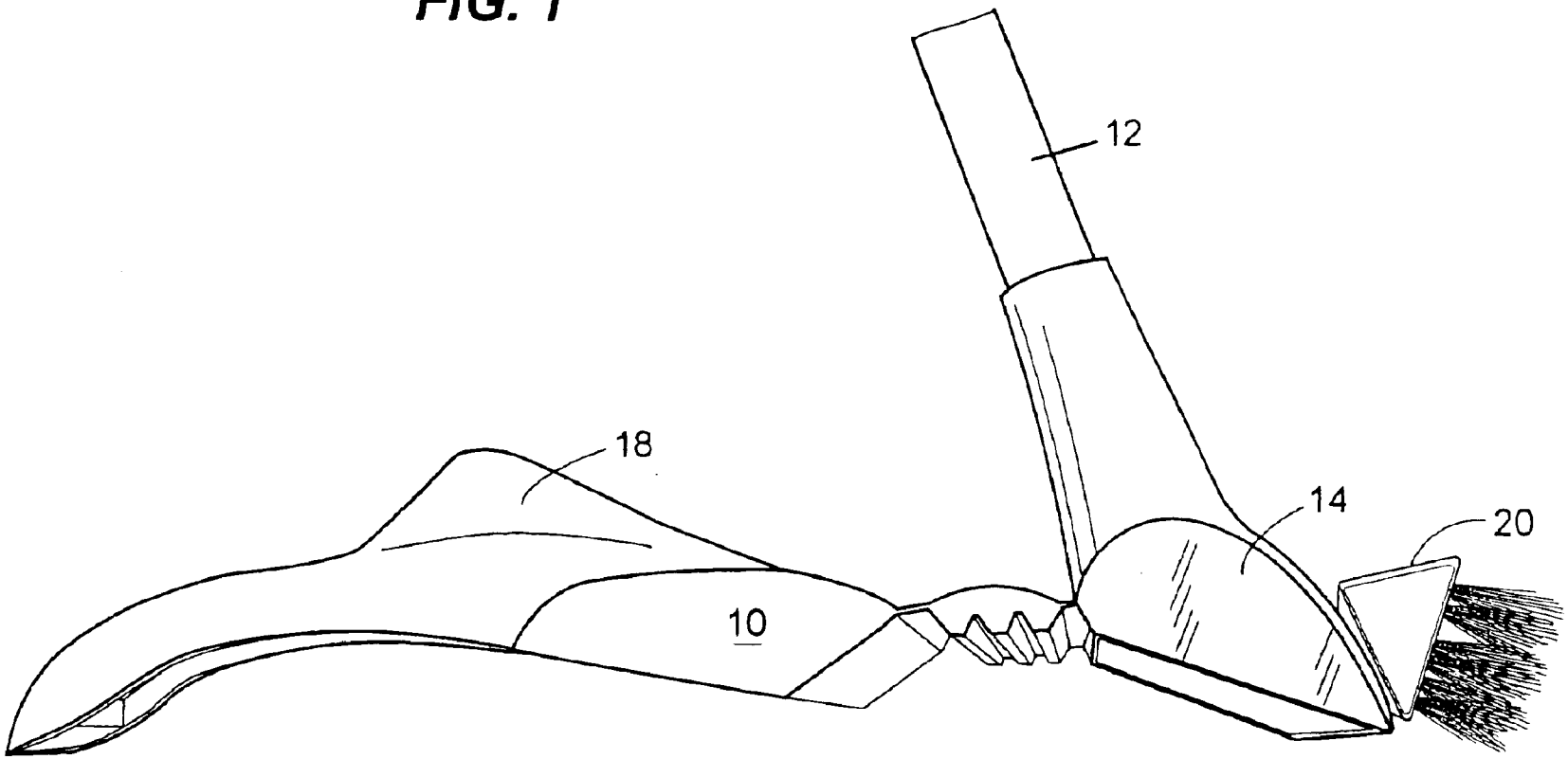
FIG. 1 is a perspective view of a mop with an attached scrubber in accordance with one embodiment of the invention.
Figure 2:
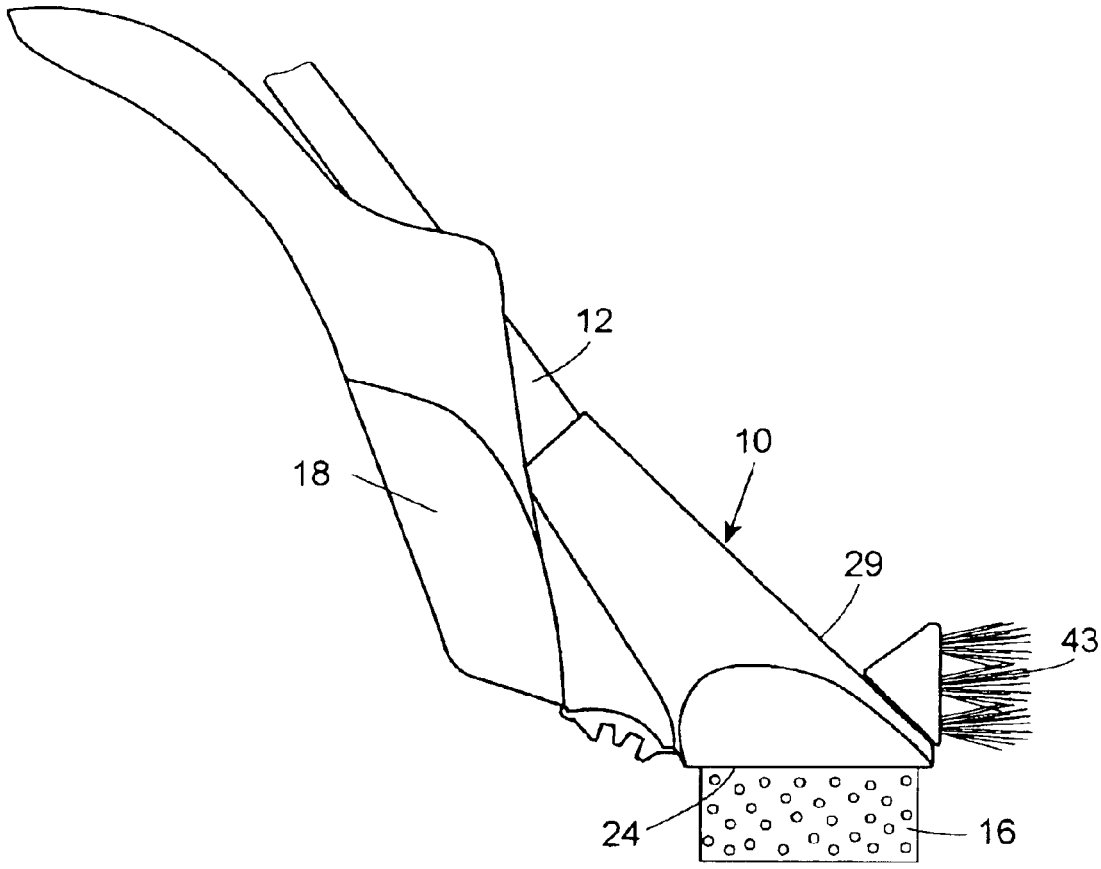
FIG. 2 is a side view of the mop seen in FIG. 1.

FIGS. 1 and 2 show one embodiment of a sponge mop 10 in accordance with the present invention. The illustrated sponge mop has a handle 12 and a mounting head 14 that is connected to the handle in a conventional way. A sponge mop element 16 is attached to the mounting head. An optional moveable wringer plate 18 can be used to wring the sponge mop element. The mop also has a scrubber 20 mounted on the mounting head.

The illustrated mounting head 14 is made of molded plastic, but other materials might also be used. The illustrated sponge mop element 16 is also conventional. Other arrangements of these elements could be used without departing from the scope of the present invention.

In the illustrated embodiment of the invention, the sponge mop element 16 is mounted to a bottom face 24 on the mounting head 14. In this embodiment, the bottom face is disposed at an angle of about 60° with respect to the length of the handle 12. This provides a convenient angle for mopping. Other arrangements can also be used.

Figure 3:
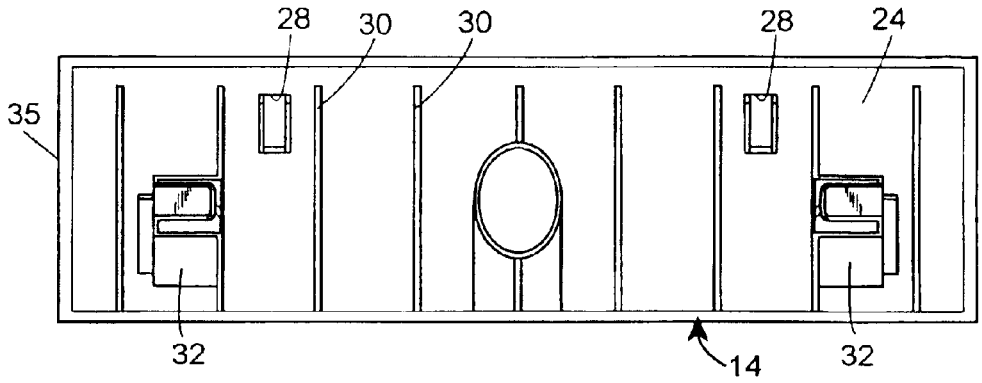
FIG. 3 is a plan view of a bottom face on the mop of FIG. 1, with the sponge mop element removed.

FIG. 3 shows the bottom face 24 with the sponge mop element 16 removed. The illustrated bottom face has two apertures 28 that pass through the mounting head 14 to a mounting face 29 on the opposite side. As seen in FIG. 2, the mounting face is angled at an angle of approximately 60° with respect to the bottom face, and is roughly parallel to the length of the handle. Although the use of two apertures is believed to be preferable, the number of apertures can vary. As illustrated, each aperture is on an opposite end of the mounting head, about five inches apart. Preferably, for a conventionally sized sponge mop, the apertures are spaced at least about two inches apart.

Figure 4:
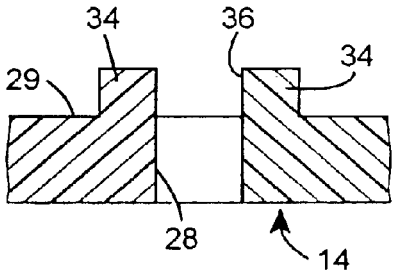
FIG. 4 is an enlarged fragmentary view of one of the apertures seen in FIG. 3.

As seen in FIG. 4, the illustrated apertures 28 are bounded on opposite sides by optional raised collar sections 34 that extend perpendicularly to the mounting face 29. The illustrated collar sections extend parallel to the short edges 35 of the mounting head 14. The illustrated collar sections are approximately 0.1 inches high, providing strength. Preferably, the inside edges 36 of the collar sections are straight and parallel.

Figure 5:
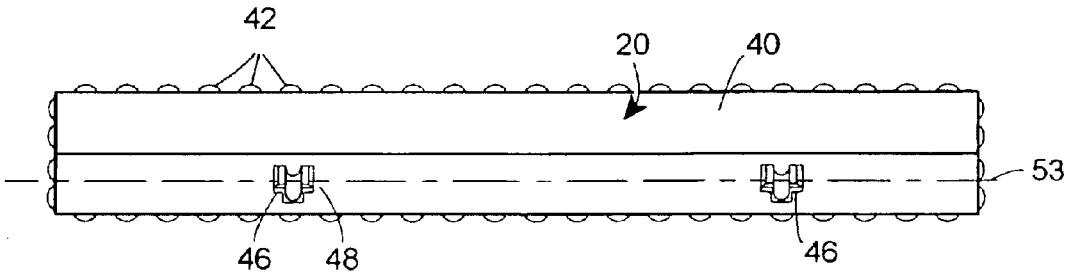
FIG. 5 is a top view of a scrubber on the mop seen in FIG. 1.

FIG. 5 shows the scrubber 20 used with the illustrated mop 10. The scrubber has a body 40 that can be made of plastic or other suitable materials. The illustrated body has a triangular cross section, with bristles 42 mounted on a scrubber face 43. An upper face 48 on the scrubber body provides a plane that lies against the mounting face 29 on the mounting head 14. Other arrangements of the scrubber could also be used. The illustrated arrangement, however, is relatively easy to manufacture and provides a good way to attach the scrubber to the mounting head at a convenient angle with respect to the handle 12. The illustrated scrubber extends the entire length of the sponge mop, about nine inches. While a full-length scrubber is believed to be preferable, other lengths can also be used.

The illustrated scrubber 20 includes two mounting stems 46 that are integrally molded on the upper face 48 of the scrubber. The mounting stems are used for attaching the scrubber to the mounting head 14. While it is preferable for the number of mounting stems to match the number of apertures 28, this is not necessary. It is also preferable, but not necessary, that the mounting stems be spaced at least about two inches apart, and closer to the lateral ends of the scrubber than to the center.

Figure 6:
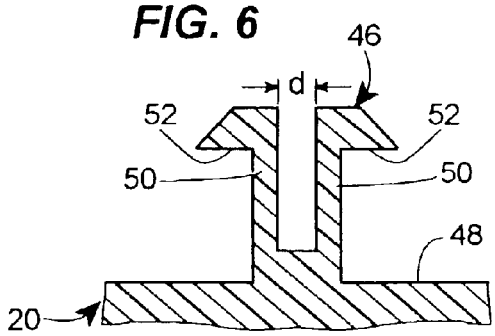
FIG. 6 is an enlarged fragmentary view of a mounting stem on the scrubber seen in FIG. 5.

The configuration of the mounting stems can vary. An example of one of the illustrated mounting stems 46 is better seen in FIG. 6. There, the mounting stem includes a pair of walls 50 that are spaced at a spacing distance "d" apart from each other. In the illustrated embodiment, each wall is about 0.1 inches thick and about 0.25 inches high. The two illustrated walls are spaced about 0.1 inches apart, and each extends parallel to the short edges 35 of the mounting head 14, and perpendicularly to a line 53 between the two mounting stems. Preferably, the walls are made of a resilient material such as deformable plastic. One of the ridges on each mounting stem extends to the left on the line between the walls, while the other ridge extends to the right. In the illustrated embodiment of the invention, the ridges extend out approximately 0.04 inches from the wall. Arrangements and shapes other than those illustrated can be used, although it is preferable that the walls be parallel and linear, and extend perpendicularly to the length of the body 40 of the scrubber.

In use, each set of walls 50 extends through and engages a corresponding aperture 28 to secure the scrubber 20 to the mounting head 14. Each of the illustrated walls includes an outwardly-extending ridge 52, the ridge extending from the wall by no more than half the spacing distance. The illustrated arrangement of the walls and ridges 52 enables the walls to be deflected inwardly so that the ridges can pass through an aperture during installation. Once the ridge passes through an aperture, the walls return to their original position, and the ridges engage the aperture to effectively prevent the scrubber from coming unattached from the mounting head. Making the walls straight permits the surface area contact of the ridges to be maximized, while the necessary deflection distance of the walls is minimized. Using apertures that extend perpendicularly to the length of the body 40 may provide increased resistance to the scrubber rolling along its axis, and spacing the apertures far apart along the length of the body 40 may help to prevent pitch and yaw of the scrubber on the mounting head.

While the walls 50 have been shown on the scrubber 20, and the apertures 28 have been shown on the mounting head 14, these relative positions could be reversed without departing from the intended scope of the invention. However, the illustrated arrangement may offer an additional benefit. Mounting the sponge mop element 16 on the bottom face 24 of the mounting head 14 covers the ridges 52, providing better aesthetics and reducing the chance of the ridges becoming disengaged from the apertures 28 and causing the scrubber 20 to become unattached.

This description of one embodiment of the invention has been provided merely for illustrative purposes. The scope of the invention is set forth in the following claims.

What is claimed is:

1. A mop comprising:

a handle;

mounting head connected to the handle;

mop element on the mounting head; and a scrubber with a triangular-shaped body that has bristles on one face and a mounting stem on another face, the scrubber being held to the mounting head by engagement of the mounting stem in an aperture on the mounting head.

2. A mop as recited in claim 1, in which:

the mounting stem extends from an upper face on the scrubber;

the bristles extend from a scrubber face on the scrubber; and the upper face and the scrubber face are disposed at about a 60° angle with respect to each other.

3. A mop as recited in claim 1, in which:

the mop clement is on a bottom face of the mounting head;

the scrubber is on a mounting face of the mounting head, and the bottom face and the mounting face are disposed at about an angle of about 60° with respect to each other.

4. A mop as recited in claim 1, in which the scrubber has a body with two faces angled at approximately 60°.

5. A mop as recited in claim 1, in which the aperture is disposed rearwardly of a front edge on the mounting head.

6. A mop as recited in claim 1, in which the mounting head has a front edge and the bristles extend outwardly from a scrubber face beyond the front edge.

7. A mop as recited in claim 1, in which the mounting head includes a bottom face and the bristles are on a scrubber face of the scrubber, and the bottom face and the scrubber face are disposed approximately perpendicular with respect to each other.

8. A mop comprising:

a handle;

a mounting head connected to the handle;

a mop element mounted on a bottom face of the mounting head; and a scrubber mounted on a mounting face of the mounting head by engagement of one or more mounting stems in one or more apertures in the mounting face;

the bottom face and the mounting face disposed at an angle of about 60° with respect to each other.

9. A mop as recited in claim 8, in which:

the one or more mounting stems extend from an upper face on the scrubber;

bristles extend from a scrubber face on the scrubber; and the upper face and the scrubber face are disposed at about a 60° angle with respect to each other.

10. A mop as recited in chain 8, in which the scrubber has a body with two faces angled at approximately 60° with respect to each other.

11. A mop as recited in claim 8, in which the one or more apertures are disposed rearwardly of a front edge on the mounting head.

12. A mop as recited in claim 8, in which the scrubber includes a scrubber face, and the bottom face and the scrubber face are disposed approximately perpendicular with respect to each other.

13. A mop as recited in claim 12, in which bristles extend from the scrubber face.

14. A mop as recited in claim 8, in which the mop include a wringer plate moveably connected to the mounting head.

15. A mop as recited in claim 8, in which the mop includes at least two mounting stems extending from the scrubber.

16. A mop comprising:

a handle;

a mounting head connected to the handle, the mounting head having a front edge;

a mop element on a bottom face of the mounting head; and a scrubber mounted on a mounting face of the mounting head by engagement of a mounting stem in an aperture disposed rearwardly of the front edge of the mounting head;

the bottom face and the mounting face disposed at an angle of about 60° with respect to each other.

17. A mop as recited in claim 16, in which:

the mounting stem extends from an upper face on the scrubber;

bristles extend from a scrubber face on the scrubber; and the upper face and the scrubber face are disposed at about a 60° angle with respect to each other.

18. A mop as recited in claim 16, in which the scrubber has a body with two faces angled at approximately 60° with respect to each other.

19. A mop as recited in chain 16, in which the scrubber includes a scrubber face, the scrubber face having bristles extending outwardly from the scrubber face beyond the front edge.

* * * * *